US005630235A

United States Patent [19]

Angstadt

[11] Patent Number: 5,630,235

[45] Date of Patent: May 20, 1997

[54] BATHTUB DRAIN REPAIR SEAL

[76] Inventor: Randall Angstadt, 17880 NE. 31st Court #2304, N. Miami Beach, Fla. 33160

[21] Appl. No.: 494,842

[22] Filed: Jun. 26, 1995

[51] Int. Cl.[6] ..... A47K 3/02

[52] U.S. Cl. ..... 4/583

[58] Field of Search ..... 4/580–583, DIG. 18

[56] References Cited

U.S. PATENT DOCUMENTS

| | | | |
|---|---|---|---|
| 3,614,793 | 10/1971 | Nemiroff | 4/580 |
| 4,067,072 | 1/1978 | Izzi | 4/288 |
| 4,106,133 | 8/1978 | Roberts | 4/DIG. 18 X |
| 4,305,165 | 12/1981 | Wall | 4/580 X |
| 4,602,393 | 7/1986 | Fiveash | 4/583 X |
| 5,153,950 | 10/1992 | Sowers | 4/580 |
| 5,330,811 | 7/1994 | Buchalter | 4/580 X |

*Primary Examiner*—Charles E. Phillips

[57] ABSTRACT

A seal for covering cracks around a drain fitting of a bathtub. The inventive device includes a flexible planar circular member having a circular center aperture directed therethrough which can be adhesively secured about a drain conduit of a bathtub and over cracks extending through the tub. A cylindrical projection depends from the circular member for positioning into a drain conduit of the bathtub to sealingly engage with a drain fitting to preclude leaking of the tub.

3 Claims, 3 Drawing Sheets

FIG 5
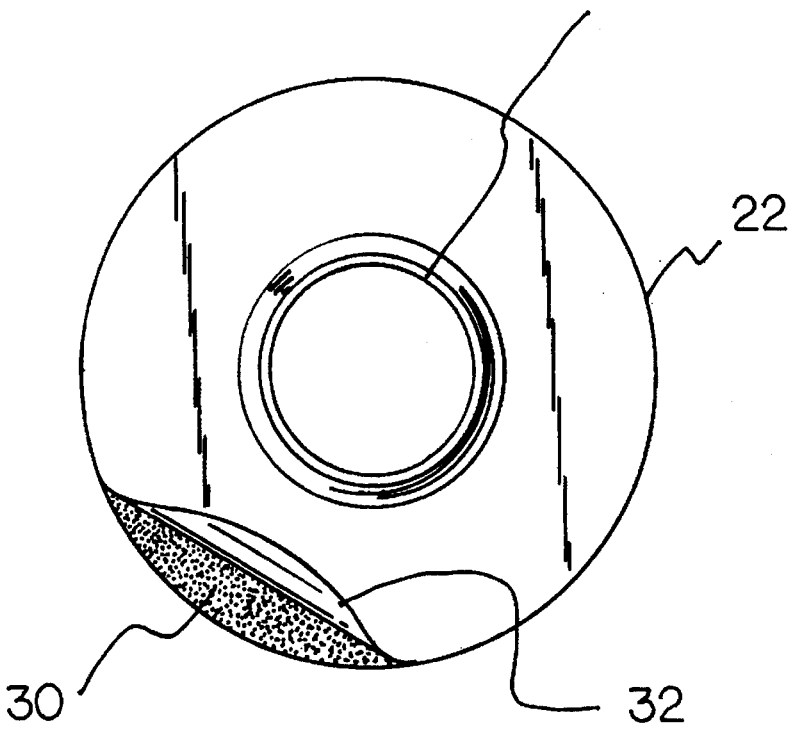
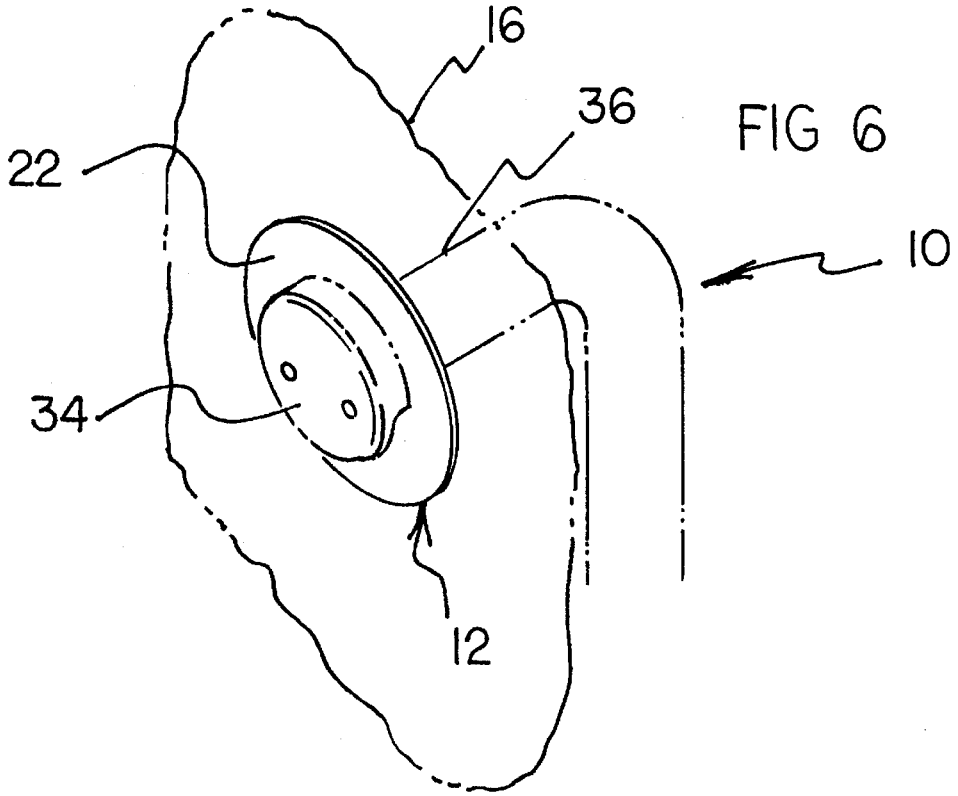
FIG 6

BATHTUB DRAIN REPAIR SEAL

BACKGROUND OF THE INVENTION

1. Field of the Invention

The present invention relates to gasket sealing structures and more particularly pertains to a bathtub drain repair seal for covering cracks around a drain fitting of a bathtub.

2. Description of the Prior Art

The use of gasket sealing structures is known in the prior art. More specifically, gasket sealing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art gasket sealing structures include U.S. Pat. No. 4,006,498; U.S. Pat. No. 4,267,609; U.S. Pat. No. 4,602,393; U.S. Pat. No. 4,630,323; U.S. Pat. No. 4,744,108; and U.S. Pat. No. 5,144,703.

While these devices fulfill their respective, particular objectives and requirements, the aforementioned patents do not disclose a bathtub drain repair seal for covering cracks around a drain fitting of a bathtub which includes a flexible planar circular member having a circular center aperture directed therethrough, and a cylindrical projection depending from the circular member for positioning into a drain conduit of the bathtub to sealingly engage with a drain fitting to preclude leaking of the tub.

In these respects, the bathtub drain repair seal according to the present invention substantially departs from the conventional concepts and designs of the prior art, and in so doing provides an apparatus primarily developed for the purpose of sealing and covering cracks around a drain fitting of a bathtub.

SUMMARY OF THE INVENTION

In view of the foregoing disadvantages inherent in the known types of gasket sealing structures now present in the prior art, the present invention provides a new bathtub drain repair seal construction wherein the same can be utilized for covering cracks around a drain fitting of a bathtub. As such, the general purpose of the present invention, which will be described subsequently in greater detail, is to provide a new bathtub drain repair seal apparatus and method which has many of the advantages of the gasket sealing structures mentioned heretofore and many novel features that result in a bathtub drain repair seal which is not anticipated, rendered obvious, suggested, or even implied by any of the prior art gasket sealing structures, either alone or in any combination thereof.

To attain this, the present invention generally comprises a seal for covering cracks around a drain fitting of a bathtub. The inventive device includes a flexible planar circular member having a circular center aperture directed therethrough which can be adhesively secured about a drain conduit of a bathtub and over cracks extending through the tub. A cylindrical projection depends from the circular member for positioning into a drain conduit of the bathtub to sealingly engage with a drain fitting to preclude leaking of the tub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub drain repair seal apparatus and method which has many of the advantages of the gasket sealing structures mentioned heretofore and many novel features that result in a bathtub drain repair seal which is not anticipated, rendered obvious, suggested, or even implied by any of the prior art gasket sealing structures, either alone or in any combination thereof.

It is another object of the present invention to provide a new bathtub drain repair seal which may be easily and efficiently manufactured and marketed.

It is a further object of the present invention to provide a new bathtub drain repair seal which is of a durable and reliable construction.

An even further object of the present invention is to provide a new bathtub drain repair seal which is susceptible of a low cost of manufacture with regard to both materials and labor, and which accordingly is then susceptible of low prices of sale to the consuming public, thereby making such bathtub drain repair seals economically available to the buying public.

Still yet another object of the present invention is to provide a new bathtub drain repair seal which provides in the apparatuses and methods of the prior art some of the advantages thereof, while simultaneously overcoming some of the disadvantages normally associated therewith.

Still another object of the present invention is to provide a new bathtub drain repair seal for covering cracks around a drain fitting of a bathtub.

Yet another object of the present invention is to provide a new bathtub drain repair seal which includes a flexible planar circular member having a circular center aperture directed therethrough, and a cylindrical projection depending from the circular member for positioning into a drain conduit of the bathtub to sealingly engage with a drain fitting to preclude leaking of the tub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a bottom plan view taken from line 5—5 of FIG. 4 illustrating an adhesive and removable backing of the invention.

FIG. 6 is an isometric illustration of an alternative form of the present invention.

DESCRIPTION OF THE PREFERRED EMBODIMENT

Figure 1:
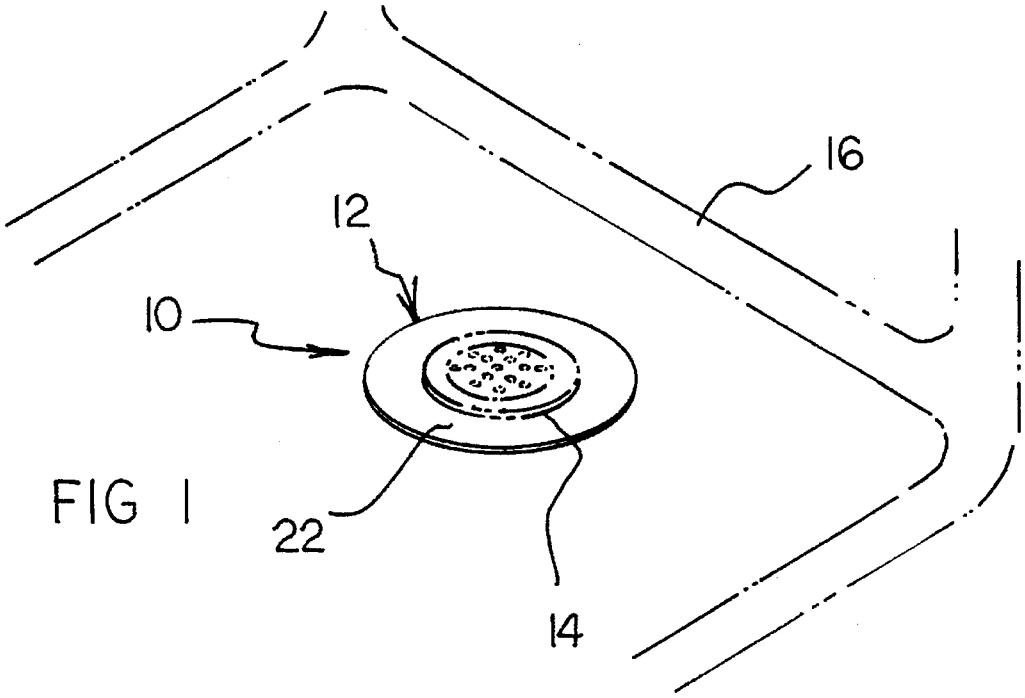
FIG. 1 is an isometric illustration of a bathtub drain repair seal according to the present invention in use.

With reference now to the drawings, and in particular to FIGS. 1–6 thereof, a new bathtub drain repair seal embodying the principles and concepts of the present invention and generally designated by the reference numeral 10 will be described.

Figure 2:
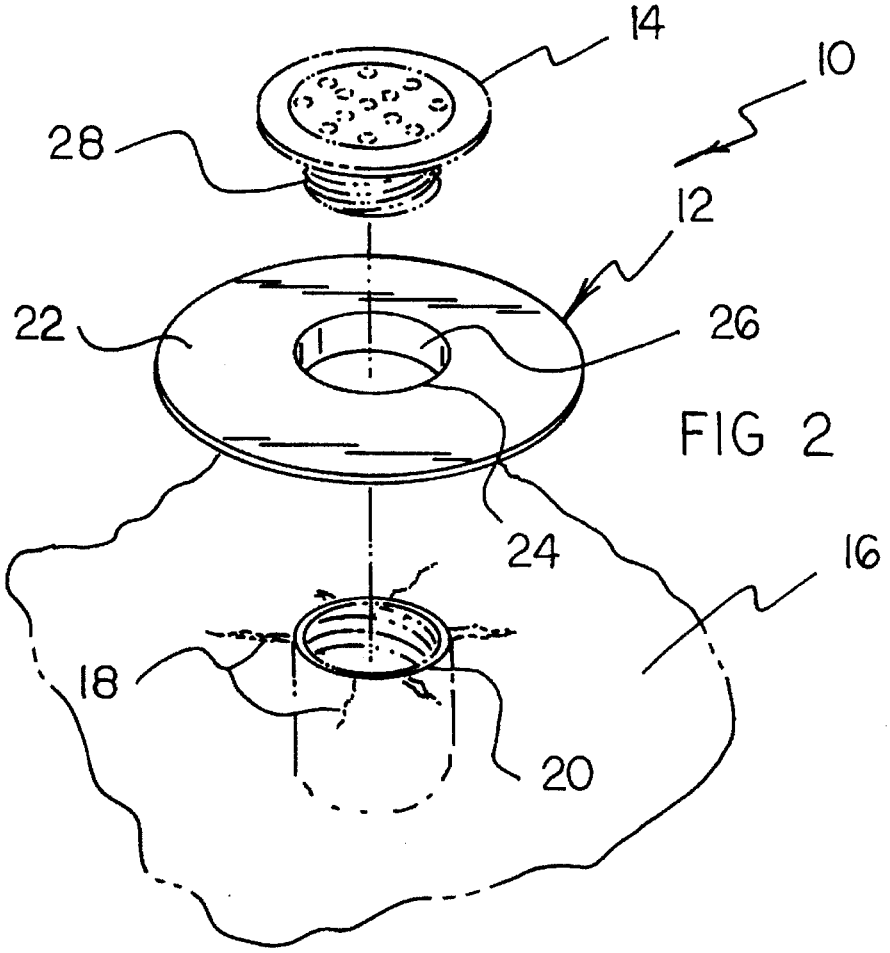
FIG. 2 is an exploded isometric illustration of the present invention.

More specifically, it will be noted that the bathtub drain repair seal 10 comprises a sealing means 12 for interposing between a drain fitting 14 and a bathtub 16 so as to seal cracks 18 extending from a drain conduit 20 of the bathtub, as shown in FIGS. 1 and 2 of the drawings. By this structure, an individual may simply seal the cracks 18 to preclude or eliminate a necessity of replacing the bathtub 16 as a result of the cracks.

Figure 3:
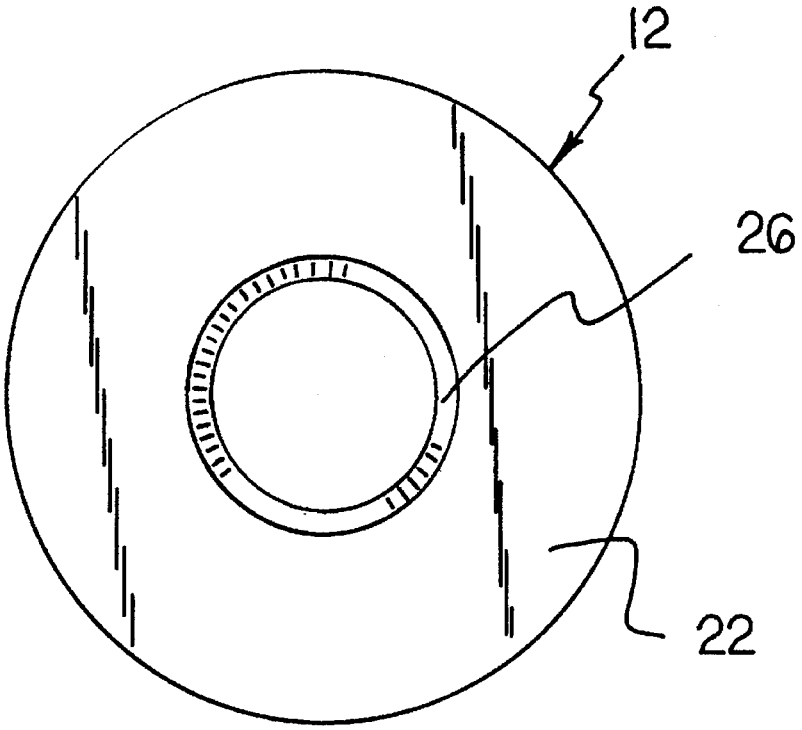
FIG. 3 is a bottom plan view thereof.
Figure 4:
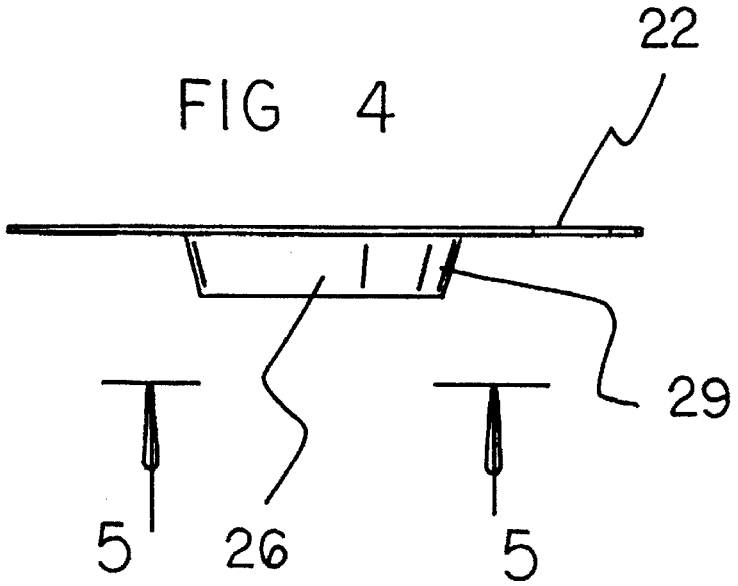
FIG. 4 is a side elevation view of the invention.

Referring now to FIGS. 2 through 4 wherein the present invention 10 is illustrated in detail, it can be shown that the sealing means 12 of the present invention preferably comprises a planar circular member 22 constructed of a substantially flexible material such as rubber or a conventionally known polymeric material which is shaped so as to define a center aperture 24 directed therethrough. A cylindrical projection 26 depends from a lower surface of the planar circular member 22 and is adapted for positioning into the drain conduit 20 of the bathtub 16. The cylindrical projection 26 is thus interposed between a threaded cylinder 28 of the drain fitting 14 and interior threads of the drain conduit 20 when the drain fitting 14 is reinstalled relative to the drain conduit. By this structure, the cylindrical projection 26 is cut by the threads of the threaded cylinder 28 so as to create a seal between the planar circular member 22 and the drain conduit 20 precluding a passage of water of other fluids through the cracks 18 of the bathtub 16. As shown in FIG. 4 the cylindrical projection 26 is preferably shaped so as to define a tapered cylindrical side wall 29 of a first diameter at a juncture of the cylindrical projection 26 and the planar circular member 22 which tapers to a second diameter distal from the juncture of the cylindrical projection and the planar circular member, wherein the first diameter is substantially greater than the second diameter so as to define a tapered shape of the tapered cylindrical side wall 29 as shown in the drawings.

The planar circular member 22 is preferably adhesively secured to the surface of the bathtub 16 by a suitable adhesive such as caulking or the like. As shown in FIG. 5, the lower surface of the planar circular member 22 can be provided with an adhesive 30 suited for sealing coupling with the surface of the bathtub 16. The adhesive 30 is preferably initially covered by a removable backing 32 which can be selectively separated therefrom by an end user prior to installation of the device 10 to an associated bathtub 16.

Referring now to FIG. 6, it can be shown that the sealing means 12 of the present invention 10 may be utilized in combination an overflow fitting 34 having an unillustrated threaded cylinder which is threadably received within an overflow conduit 36 of the bathtub 16. In this configuration of the device 10, the planar circular member 22 is adhesively secured to the surface of the bathtub 16 about the overflow conduit 36 so as to seal any cracks extending through the bathtub.

In use, the bathtub drain repair seal 10 according to the present invention can be easily utilized to effect sealing and covering of cracks around a drain fitting 14 or overflow fitting 34 of an associated bathtub 16, as shown in FIGS. 1 and 6 of the drawings. The present invention 10 substantially eliminates a need of replacing a bathtub 16 having cracks 18 extending therethrough, thereby saving an end user of the device a substantial amount of money in repair costs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bathtub drain repair seal comprising:

a bathtub having a drain conduit and a drain fitting coupled to the drain conduit, the bathtub including cracks extending therethrough;

a sealing means interposed between the drain fitting and the drain conduit for sealing the cracks of the bathtub, the sealing means comprising a substantially flexible planar circular member shaped so as to define a center aperture directed therethrough, the planar circular member being concentrically positioned over the drain conduit, with the drain fitting extending through the center aperture, the sealing means further comprising a cylindrical projection concentrically positioned about the center aperture of the planar circular member and depending from a lower surface of the planar circular member, the cylindrical projection being positioned into the drain conduit of the bathtub, said drain fitting includes a threaded cylinder threadably engaged with interior threads of the drain conduit, the cylindrical projection being interposed between the threads of the drain fitting and the drain conduit.

2. The bathtub drain repair seal of claim 1, wherein the cylindrical projection is shaped so as to define a tapered cylindrical side wall of a first diameter at a juncture of the cylindrical projection and the planar circular member which tapers to a second diameter distal from the juncture of the cylindrical projection and the planar circular member, wherein the first diameter is substantially greater than the second diameter so as to define a tapered shape of the tapered cylindrical side wall.

3. The bathtub drain repair seal of claim 2, wherein the sealing means further comprises an adhesive applied to a lower surface of the planar circular member and secured to the bathtub.

* * * * *